US006074759A

United States Patent [19]

Kohl et al.

[11] Patent Number: 6,074,759

[45] Date of Patent: Jun. 13, 2000

[54] MEDIA SUITABLE FOR THE THERMAL TRANSFER OF LAYERS

[75] Inventors: Albert Kohl, Laumersheim; Norbert Schneider, Altrip; Karl-Heinz Römer, Frankenthal; Jürgen Richter, Willstätt; Peter Heilmann, Bad Dürkheim; Michael Hitzfeld, Karlsruhe, all of Germany

[73] Assignee: EMTEC Magnetics GmbH, Germany

[21] Appl. No.: 08/900,715

[22] Filed: Jul. 28, 1997

[30] Foreign Application Priority Data

Aug. 1, 1996 [DE] Germany ..... 196 31 007

[51] Int. Cl.[7] ..... B41M 5/10

[52] U.S. Cl. ..... 428/488.4; 428/195; 428/327; 428/413; 428/500; 428/522; 428/532; 428/913; 156/60; 156/81

[58] Field of Search ..... 428/195, 207, 428/212, 484, 488.1, 488.4, 913, 411.1, 914

[56] References Cited

U.S. PATENT DOCUMENTS

| | | | |
|---|---|---|---|
| 4,273,602 | 6/1981 | Kosaka et al. | 156/254 |
| 4,463,034 | 7/1984 | Tokunaga et al. | 427/256 |
| 4,564,534 | 1/1986 | Kushida et al. | 427/256 |
| 4,600,628 | 7/1986 | Ishii et al. | 428/216 |
| 4,840,837 | 6/1989 | Tanaka et al. | 428/216 |
| 4,970,119 | 11/1990 | Koshizuka et al. | 428/411.1 |
| 5,028,475 | 7/1991 | Nishibuchi | 428/195 |
| 5,215,810 | 6/1993 | Koshizuka et al. | 428/195 |
| 5,219,638 | 6/1993 | Imamura et al. | 428/195 |
| 5,250,346 | 10/1993 | Nagai et al. | 428/195 |
| 5,362,549 | 11/1994 | Imamura et al. | 428/195 |
| 5,456,969 | 10/1995 | Suzuki et al. | 428/195 |
| 5,480,703 | 1/1996 | Suematsu | 428/195 |
| 5,605,766 | 2/1997 | Arimura et al. | 428/488.4 |

FOREIGN PATENT DOCUMENTS

| | | |
|---|---|---|
| 434 420 | 6/1991 | European Pat. Off. . |
| 658 444 | 6/1995 | European Pat. Off. . |

OTHER PUBLICATIONS

U.S. application No. 8/696,183, Kohl et al., filed Aug. 13, 1996.

*Ullmann's Encyc.*, vol. A21, pp. 665–716.

*Primary Examiner*—Bruce H. Hess
*Assistant Examiner*—Michael E Grendzynski
*Attorney, Agent, or Firm*—Keil & Weinkauf

[57] ABSTRACT

Media I suitable for the thermal transfer of a layer contain a) a substrate II, b) a layer III thereon, containing 1) from 75 to 90% by weight of a polymer IV having a softening point of from 100 to 160° C., and 2) from 10 to 25% by weight of a polymer V having a softening point of at least 90° C.

and c) a layer VI containing a polymer VII.

7 Claims, No Drawings

MEDIA SUITABLE FOR THE THERMAL TRANSFER OF LAYERS

FIELD OF THE INVENTION

The present invention relates to media I suitable for the thermal transfer of a layer and containing a) a substrate II, b) a layer III thereon, containing 1) from 75 to 90% by weight of a polymer IV having a softening point of from 100 to 160° C. and 2) from 10 to 25% by weight of a polymer V having a softening point of at least 90° C., and c) a layer VI containing a polymer VII.

It furthermore relates to those media which contain a pigment VIII, in particular a ferromagnetic one, in the layer VI, those media which contain, on the layer VI, a further layer IX which contains a compound X suitable as an adhesive, the use of such media for transferring layers III and VI to substrate XII, layer-like media XI which contain a substrate XII and can be obtained by reacting a medium I with a substrate XII, and a process for the production of media XI.

Media for the thermal transfer of layers applied on a substrate to receiving material are generally known.

BACKGROUND OF THE INVENTION

For the transfer of these layers, the layer side of a corresponding medium is brought into contact with a receiving material and the layer is transferred from the substrate to the receiving material by the action of heat. To facilitate the separation of the layer from the substrate, a release layer is usually inserted between the substrate and the layer to be transferred.

EP-A 658 444 describes a medium which contains a substrate, a release layer applied thereon and containing at least 50% by weight of a polyethylene wax having a melting point of at least 100° C. and, thereon, a further heat-fusible layer which contains a dye and a binder, the binder comprising at least 50% by weight of carnauba wax.

It is known that carnauba wax is understood, for example according to Römpp Chemie Lexikon, 9th edition, Georg Thieme Verlag, Stuttgart-New York, 1989, page 594, as meaning a vegetable wax having a melting point of from 83 to 86° C.

However, such media do not have satisfactory abrasion resistance on the side of the layer to be transferred. Moreover, mixtures of the components of the release layer with the components of the layer to be transferred lead to unsatisfactory results on the receiving material during the thermal transfer process. In addition, with the media described, an orientation of pigments achieved during the production of the layer to be transferred as is desired in particular in the case of pigments having anisotropic properties, in particular ferromagnetic pigments, cannot be maintained during the transfer of the layer.

SUMMARY OF THE INVENTION

It is an object of the present invention to provide media for the thermal transfer of layers applied on a substrate to a receiving material, by means of which media the disadvantages described can be overcome in a technically simple and economical manner.

We have found that this object is achieved by a medium I suitable for the thermal transfer of a layer and containing a) a substrate II, b) a layer III thereon, containing 1) from 75 to 90% by weight of a polymer IV having a melting point or softening point of from 100 to 160° C., and 2) from 10 to 25% by weight of a polymer V having a melting point or softening point of at least 90° C.

and c) a layer VI containing a polymer VII.

DETAILED DESCRIPTION OF THE INVENTION

The substrates II which may be used comprise the conventional rigid or flexible substrate materials, in particular films, which have sufficient thermal conductivity and heat stability for the thermal transfer of an applied layer, and preferably comprise polyesters such as polyethylene naphthalate, polyarylates and in particular polyethylene terephthalate, polycarbonate, polyamides, aramids and mixtures of such compounds, or paper, such as capacitor paper. A medium I may contain one substrate II comprising a plurality of substrate material layers or preferably one substrate material layer. The thickness of a substrate II should be in general from 8 to 75 mm, preferably from 12 to 38 mm, in particular from 20 to 26 mm.

The substrate may have a lubricant-containing layer on the surface facing away from the layer III. Particularly suitable lubricants are polymers which have sufficient thermal conductivity and stability for the thermal transfer of a layer, for example silicones, fluorine-containing polymers, such as polyvinyl fluoride and polyvinylidene difluoride, cellulose esters, such as cellulose nitrates, cellulose acetates, cellulose acetopropionates and cellulose acetobutyrates, polymers which are modified with such polymers, such as silicone-modified urethanes and silicone-modified acrylates, and mixtures of such lubricants.

For the production of the lubricant-containing layer, a lubricant and, if required, additives or binders can be applied to the substrate in a manner known per se in the absence of a solvent or, preferably, in the presence of an organic diluent. The further processing can be carried out in a conventional manner, for example by removing the solvent and, if a crosslinkable binder is used, curing the binder with subsequent calendering.

As usual, the diluents used may be water, ethers, such as tetrahydrofuran or dioxane, ketones, such as methyl ethyl ketone or cyclohexanone, esters, such as ethyl acetate, or hydrocarbons, such as alkanes or aromatics, or mixtures of such compounds.

It is known that suitable binders are polyurethanes, polyacryl-ates, polymethacrylates, polyacrylamide, vinyl polymers, such as polystyrene, polyvinyl chloride, polyvinyl acetate, polyvinyl propionate and polyacrylonitrile, cellulose-containing binders, such as cellulose esters, in particular cellulose nitrates, cellulose acetates, cellulose acetopropionate and cellulose acetobutyrate, phenoxy resins and epoxy resins.

Additives known to be used are fillers, such as inorganic and organic pigments, eg. alumina, silica, titanium dioxide, carbon black, polyethylene and polypropylene, chalking inhibitors, eg. antimony oxide, and thixotropic substances, eg. amorphous silica.

According to the invention, the layer III contains from 75 to 90, preferably from 80 to 85, % by weight, based on the layer III, of a polymer IV having a melting point or softening point of from 100 to 160° C., preferably from 100 to 120° C., and from 10 to 25, preferably from 15 to 20, % by weight, based on the layer III, of a polymer V having a melting point or softening point of at least 90° C., preferably at least 100° C.

Suitable monomers of which the polymers IV are for the most part composed are primarily olefinically unsaturated hydrocarbons, such as ethylene and propylene.

Up to 20, preferably from 0 to 5, mol % of monomers by means of which the mechanical, thermal and chemical properties of the polymers composed only of the stated monomers are modified but not substantially changed are suitable as further comonomers for the synthesis of the polymers IV.

Such comonomers are, for example, olefinically unsaturated aromatic hydrocarbons, such as styrene and a-methylstyrene, unsaturated nitriles, such as acrylonitrile and methacrylonitrile, halogenated olefins, such as vinyl chloride, vinyl alcohol derivatives, such as vinyl acetate, and in particular monoesters of a,b-unsaturated carboxylic acids of the formula

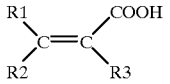

where $R^1$, $R^2$ and $R^3$ are each hydrogen or $C_1$–$C_4$-alkyl, and acrylic acid and methacrylic acid being preferred, and mixtures of different carboxylic acids of this type with $C_9$–$C_{25}$-alkanols, such as nonanol, stearyl alcohol and lauryl alcohol, preferably with $C_1$–$C_8$-alkanols, in particular methanol and n-butanol, or polyhydric alcohols, such as ethanediol, propane-1,2-diol, propane-1,3-diol, the butanediols, glycerol and mixtures of these alcohols.

Particularly suitable polymers IV are waxes, in particular polyolefin waxes, such as polyethylene waxes, which may be unmodified or may be modified by known methods, such as oxidation.

A compound or homogeneous or inhomogeneous mixtures of a plurality of compounds may be used as polymers IV.

The polymers IV may be present in the layer III as a homogeneous or, preferably, inhomogeneous mixture with a polymer V. In the case of an inhomogeneous mixture, the polymers IV may be present in different geometric shapes, such as needle-shaped, sheet-like or, preferably, spherical. Spherical bodies are understood as meaning one for whose distance between the outermost point P of the envelope curve and the geometric midpoint of the body, relative to the average distance A of all points of the envelope curve from the geometric midpoint of the body, the following applies:

$$P \leqq 1.5 \times A$$

preferably $$P \leqq 1.2 \times A$$

Suitable polymers V are primarily polyurethanes, polyacrylates, polymethacrylates, polyacrylamide, vinyl polymers, such as polystyrene, polyvinyl chloride, polyvinyl acetate, polyvinyl propionate and polyacrylonitrile, cellulose-containing binders, such as cellulose esters, in particular cellulose nitrates, cellulose acetates, cellulose acetopropionate and cellulose acetobutyrate, and in particular phenoxy resins and epoxy resins, as obtainable, for example, by reacting bisphenol A with epichlorohydrin and commercially available under the name PKHH (from Union Carbide Corporation) or Pheno Tohto YP-50S (from Tohto Kasei Co. Ltd.), and mixtures of such compounds.

The polymers V may contain reactive functional groups, such as amino groups, preferably primary and secondary amino groups, mercapto groups, acid groups, isocyanate groups or in particular hydroxyl groups or a plurality of different groups of these types.

The media I may contain a layer III or a plurality of identical or different layers III, for example two or three such layers.

According to the invention, the layer VI contains up to 100% by weight, based on the layer VI, of a polymer VII.

Suitable polymers VII are primarily polyacrylates, polymethacryl-ates, polyacrylamide, vinyl polymers, such as polystyrene, polyvinyl chloride, polyvinyl acetate, polyvinyl propionate and polyacrylonitrile, cellulose-containing binders, such as cellulose esters, in particular cellulose nitrates, cellulose ace-tates, cellulose acetopropionate and cellulose acetobutyrate, phenoxy resins and epoxy resins, in particular polyurethanes, as obtainable, for example, by reacting polyhydric high molecular weight alcohols, for example hydroxyl-containing polyesters, or polyhydric low molecular weight alcohols, and compounds having amino groups reactive toward isocyanates, instead of the hydroxyl groups of the stated alcohols, with polyhydric isocyanates, as well as mixtures of such compounds. Such polyurethanes are described, for example, in Ullmann's Encyclopedia of Industrial Chemistry, 5th edition, Vol. 21, VCH Verlagsgesellschaft GmbH, Weinheim, 1992, pages 665–716.

The polymers VII may contain reactive functional groups, such as hydroxyl groups, amino groups, preferably primary and secondary amino groups, mercapto groups, acid groups or in particular isocyanate groups or a plurality of different groups of these types.

Particularly advantageous media I are those in which the polymers V contain functional groups which are capable of reacting with functional groups contained in the polymers VII, in particular primary or secondary amino groups or hydroxyl groups of the polymer VII with isocyanate groups of the polymer V or particularly preferably primary or secondary amino groups or hydroxyl groups of the polymer V with isocyanate groups of the polymer VII.

The layer VI may contain organic or inorganic pigments, such as colored pigments or in particular ferromagnetic pigments or mixtures of such pigments.

Suitable magnetic pigments are the conventional oxide pigments, such as $\gamma$—$Fe_2O_3$, $\gamma$—$Fe_3O_4$ and $CrO_2$, or metallic pigments, such as Fe, Co and Ni. It is generally known that these pigments may contain further chemical elements or compounds such as aluminum, silicon or boron.

Particularly advantageous pigments are those which essentially comprise Fe—Al, Fe—Si, Fe—Al—Si, Fe—B, Fe—Si—B, Fe—Al—B or Fe—Al—B—Si, the total amount of such further elements or compounds preferably being from 0.5 to 20% by weight, based on Fe.

The media I may contain one layer VI or a plurality of identical or different layers VI, for example two or three such layers.

A further layer IX which contains a compound X suitable as an adhesive, preferably in a binder matrix XIII, may advantageously be applied to the layer VI.

The glass transition temperature of the compound X should advantageously be less than the melting point of the matrix XIII, preferably by from 1 to 100° C., in particular from 5 to 30° C., and should be higher than the glass transition temperature of the matrix XIII, the compound X should in particular be tack-free at up to at least 60° C.

Suitable compounds X and systems comprising a compound X and a matrix XIII are described, for example, in U.S. Pat. No. 5,763,074.

That amount of the compound X in the layer IX which is required for achieving the desired adhesion of the thermally transferred layer of the medium I to the receiving substrate XII can readily be determined by a few simple preliminary experiments, the amount of the compound X depending not only on the compound X but to a great extent on the nature of the receiving substrate XII.

Cardboard, polyethylene, polyethylene terephthalate, preferably paper, polyvinyl chloride or polypropylene may advantageously be used as substrate XII.

The media I may contain one layer IX or a plurality of identical or different layers IX, for example two or three such layers.

For the production of media I, a mixture containing a polymer IV, a polymer V and a liquid diluent, if necessary with further additives, such as a dispersant, can first be applied in a manner known per se to the substrate II in order to form a layer III.

As usual, water, ethers, such as tetrahydrofuran or dioxane, ketones, such as methyl ethyl ketone or cyclohexanone, esters, such as ethyl acetate, or hydrocarbons, such as alkanes or aromatics, or mixtures of such compounds may be used as liquid diluents.

In the usual manner, cationic, nonionic or preferably anionic surfactants, such as carboxylates, sulfonates, phosphonates of hydrocarbons, in particular alkyl or aryl compounds, may be used as dispersants.

For the formation of a layer VI, a mixture containing a polymer VII and a liquid diluent, if necessary with pigments VIII and further additives, such as dispersants, lubricants or leveling agents, may be applied to a layer III.

As usual, water, ethers, such as tetrahydrofuran or dioxane, ketones, such as methyl ethyl ketone or cyclohexanone, esters, such as ethyl acetate, or hydrocarbons, such as alkanes or aromatics, or mixtures of such compounds may be used as liquid diluents.

In the usual manner, cationic, nonionic or preferably anionic surfactants, such as carboxylates, sulfonates or phosphonates of hydrocarbons, in particular alkyl or aryl compounds, may be used as dispersants.

For the formation of a layer IX, a mixture containing a compound X and a liquid diluent, if necessary with further additives, such as fillers, may be applied to a layer VII.

As usual, water, ethers, such as tetrahydrofuran or dioxane, ketones, such as methyl ethyl ketone or cyclohexanone, esters, such as ethyl acetate, or hydrocarbons, such as alkanes or aromatics, or mixtures of such compounds, may be used as liquid diluents.

As usual, suitable fillers are inorganic or organic pigments, eg. alumina, silica, carbon black, polyethylene and polypropylene.

Before the application of the subsequent layer in each case, the layers may be essentially dried and, if required, aftertreated, eg. calendered, in a manner known per se. Furthermore, the layers may be applied one on top of the other without a substantial drying step in a manner known per se, for example by the wet-on-wet method.

If the layer VI contains ferromagnetic pigments, it is advisable to orient the pigments in a strong magnetic field in order to use the layer as a magnetic recording medium.

The media I can be used for the production of layer-like media XI which contain a substrate XII, the media XI being obtainable in a manner known per se by reacting a medium I with a substrate XII by bringing a medium I into contact with a substrate XII while I and XII are at from 80 to 180° C., preferably from 100 to 150° C. and under from 1 to 12, preferably from 3 to 8, bar, the layers III and VI being present between the layer II and the substrate XII, resulting in general in contact times of from 0.2 second to 5 minutes.

EXAMPLE

In the Examples which follow, parts are by weight unless stated otherwise.

Production of a Medium I

1) Application of a layer III to a substrate II

A mixture of 150 parts of a micronized, spherical polyethylene wax having a melting range of from 110 to 115° C., 90 parts of a phenoxy resin having 6% by weight of secondary hydroxyl groups, 10.2 parts of a dispersant comprising an ester of a fatty alcohol phosphoric acid, 1380 parts of tetrahydrofuran (THF) and 1380 parts of dioxane was dispersed for 6 hours in a stirred ball mill containing ceramic balls having a diameter of from 1.0 to 1.5 mm, and the dispersion was diluted with 1000 parts of THF and 1000 parts of dioxane and filtered through a filter having a pore size of 10 mm.

A 24 $\mu$m thick polyethylene terephthalate film was then coated with a dispersion by means of an engraved roller and the coating was dried at 80° C. The thickness of the layer III was 0.5 m.

2) Application of a layer VI a) Preparation of the dispersion according to EP-A 281 873, Example 2

900 g of a ferromagnetic chromium dioxide pigment having a mean particle size of 0.5 mm, a length/width ratio of from 4:1 to 9:1, a coercive force of 40.0 kA/m and a specific surface area of 20 $m^2/g$ were introduced, together with 30.3 g of a 12.5% strength solution of a polyurethane obtained from 6600 parts of a polyesterdiol of adipic acid and 1,4-butanediol (number average molecular weight about 1000), 778 parts of 1,4-butanediol, 42 parts of trimethylolpropane and 43 parts of diphenylmethylene 4,4'-diisocyanate in THF, 81 g of a 20% solution of a polyvinyl formal, consisting of 82% of vinylformal units, 12% of vinyl acetate units and 6% of vinyl alcohol units, in THF, 13.5 g of zinc stearate, 4.5 g of stearylamide, 4.5 g of N-tallow fat-1,3-diaminodioleate, 457 g of THF and 457 g of dioxane, into a steel ball mill having a capacity of 6 l and containing 8 kg of steel balls having a diameter of from 4 to 6 mm, and were dispersed for 72 hours. Thereafter, a further 818 g of the stated polyurethane solution and 219 g of the stated polyvinyl formal solution were added and dispersing was continued for a further 24 hours. The dispersion was then filtered under pressure, the filter having a pore size of 5 mm. After the filtration, 17 g of a 50% strength solution of a triisocyanate of 3 mol of tolylene diisocyanate and 1 mol of trimethylolpropane were added per kg of dispersion, with vigorous stirring.

b) Coating

The dispersion was applied by means of a knife coater to the layer III obtained according to step (1). After passing through a magnetic field for orientation of the ferromagnetic pigments, the coated film was dried at from 50 to 90° C. After drying, the layer was compacted and calendered by being passed between heated rollers, so that the thickness of the layer VI was 10 mm.

3) Application of a layer IX a) Preparation of the emulsion

A solution of 9.6 kg of epoxy resin Epikote 1700 (from Shell) having a glass transition temperature $T_g$ of 70° C. and a melting point $T_m$ of 117° C. in 11.2 kg of acetone and 11.2 kg of methyl ethyl ketone (MEK), a solution of 2.55 kg of a hydroxyl-containing, highly crystalline polyesterurethane having a $T_g$ of 35° C. and a $T_m$ of 110° C. in 7.22 kg of acetone and 7.22 kg of MEK and a solution of 2.85 kg of amorphous general purpose polystyrene granules having a $T_g$ of 95° C. and a broad elastomeric range of from 105° C. to at least 180° C. in 3.32 kg of acetone and 3.32 kg of MEK are added in succession to a vigorously stirred mixture of 20.75 kg of acetone and 20.75 kg of MEK in a stirred vessel having a volume of 150 l.

An emulsion which contained the polystyrene in spherical form with a particle diameter of from 4 to 6 mm was obtained.

b) Coating

The emulsion was applied by means of a knife coater to the layer VI obtained according to step (2). The coated film was dried at 70° C. and wound into a roll. The thickness of the layer IX was 4 $\mu$m.

4) Production of the medium XI

The medium I obtained in steps 1 to 3 and a flexible, nonmagnetic paper web XII were each unwound synchronously from a take-off roll and brought into contact so that the layer IX touched the paper web. The coating of the layer II was transferred to the paper web at a linear velocity of 150 m/s with the aid of a rotating steel roller heated to 170° C. and pressed with a pressure of 5 kg/cm onto the uncoated side of the layer II of the medium I, so that I and XII were at a temperature from 120 to 140° C. The remaining layer II and medium I and the medium XI were then each wound into a roll.

The novel media I had an excellent transfer behavior, in particular at high transfer speeds.

The novel media XI are very hard-wearing and have good abrasion resistance and excellent magnetic properties, such as recording and storage properties, while avoiding drops in output level.

What is claimed is:

1. A medium suitable for the thermal transfer of a layer which contains a) a substrate, b) a first transferable layer directly thereon, consisting essentially of 1) from 75 to 90% by weight of a polymer of polyolefinic hydrocarbons having a melting point or softening point of from 100 to 160° C., and 2) from 10 to 25% by weight of a polymer selected from the group consisting of phenoxy resins and epoxy resins having a melting point or softening point of at least 90° C.

and thereon c) a second transferable layer consisting essentially of a polymer selected from the group consisting of polyacrylates, polymethacrylates, polyacrylamide, vinyl polymers, cellulose-containing binders, phenoxy resins and epoxy resins and polyurethanes and a ferromagnetic pigment.

2. A medium I as claimed in claim 1, containing a polyethylene was as polymer IV.

3. A medium I as claimed in claim 1, containing a spherical plymer IV.

4. A medium as claimed in claim 1 wherein the polymer in component b) 2) and the polymer in component c) contain functional groups which react with each other.

5. A medium as claimed in claim 1, further containing an adhesive-containing layer which is applied on the layer of layer c).

6. A medium having a layer structure obtained by bringing the layered side of the medium of claim 1 into contact with a second substrate so that the layers in the resulting medium are present between the substrates.

7. A process for the production of the medium as claimed in claim 6, which comprises bringing into contact the medium of claim 1 with said second substrate at a temperature of from 80 to 180° C.

* * * * *

UNITED STATES PATENT AND TRADEMARK OFFICE

CERTIFICATE OF CORRECTION

PATENT NO. : 6,074,759
DATED : June 13, 2000
INVENTOR(S) : Kohl et al.

It is certified that error appears in the above-identified patent and that said Letters Patent is hereby corrected as shown below:

Column 8,
Claims 2 and 3 should read as follows:

-- 2. A medium as claimed in claim 1, wherein componet b)1) contains a polyethylene as a polymer IV.

-- 3. A medium as claimed in claim 1, wherein componet b)1) contains said polymer in a spherically shaped particle form.

Signed and Sealed this

Twenty-fourth Day of July, 2001

*Attest:*

Nicholas P. Godici

*Attesting Officer*

NICHOLAS P. GODICI
*Acting Director of the United States Patent and Trademark Office*